United States Patent [19]

de la Morandiere et al.

[11] Patent Number: 4,636,613

[45] Date of Patent: Jan. 13, 1987

[54] COMBINATION DRYER AND IRON

[75] Inventors: Anne J. de la Morandiere, 200 East 72nd St., Apt. 3E, New York, N.Y. 10021; Peter W. Bressler, Philadelphia, Pa.; Peter D. Byar, Willingboro, N.J.; Edward A. Spector, Philadelphia, Pa.

[73] Assignee: Anne J. de la Morandiere, New York, N.Y.

[21] Appl. No.: 721,619

[22] Filed: Apr. 10, 1985

[51] Int. Cl.[4] ..... H05B 1/00; D06F 75/00; A45D 20/12; F24H 3/04

[52] U.S. Cl. ..... 219/249; 34/91; 34/97; 34/243 R; 38/75; 38/82; 38/88; 219/254; 219/361; 219/367; 219/368; 219/370; 219/373; 219/474

[58] Field of Search ..... 219/245, 249, 254, 373, 219/361, 472–474, 367–370; 38/69, 74, 75, 82, 84, 88, 90, 93; 34/90, 91, 96, 97, 243 R

[56] References Cited

U.S. PATENT DOCUMENTS

| | | | |
|---|---|---|---|
| 975,936 | 11/1910 | Charles . | |
| 1,018,576 | 2/1912 | Madsden . | |
| 1,293,010 | 2/1919 | Bloch . | |
| 1,466,139 | 8/1923 | Michie . | |
| 1,789,869 | 1/1931 | Herrmann . | |
| 1,831,742 | 11/1931 | Homer . | |
| 1,862,912 | 6/1932 | Sologaistoa . | |
| 1,892,792 | 1/1933 | Thompson . | |
| 1,998,313 | 4/1935 | Fingerhart et al. . | |
| 1,998,776 | 4/1935 | Collins . | |
| 2,186,930 | 1/1940 | Scharf . | |
| 2,320,013 | 5/1943 | Scharf | 38/89 |
| 2,362,590 | 11/1944 | Smith | 38/89 |
| 2,362,591 | 11/1944 | Smith | 38/75 |
| 2,373,345 | 4/1945 | Scharf | 38/89 |
| 2,479,429 | 8/1949 | Swenson | 38/79 |
| 2,501,683 | 3/1950 | Landon . | |
| 2,624,832 | 1/1953 | Moyer . | |
| 2,639,520 | 5/1953 | Anderson et al. | 38/75 |
| 2,727,322 | 12/1955 | Swenson | 38/90 |
| 2,786,287 | 3/1957 | Swann | 38/77 |
| 2,811,794 | 11/1957 | De Angelis | 38/90 |
| 2,827,060 | 3/1958 | Marty | 219/373 X |
| 3,064,360 | 11/1962 | Sholin | 34/91 |
| 3,157,475 | 11/1964 | Stainbrook | 38/91 |
| 3,258,578 | 6/1966 | Ferris | 219/273 |

(List continued on next page.)

FOREIGN PATENT DOCUMENTS

| | | | |
|---|---|---|---|
| 48-21008 | 6/1973 | Japan | 219/245 |
| 54-40218 | 11/1979 | Japan | 219/245 |
| 56-80207 | 7/1981 | Japan | 219/245 |
| 56-153307 | 11/1981 | Japan | 219/245 |
| 56-153306 | 11/1981 | Japan | 219/245 |

OTHER PUBLICATIONS

Mademoiselle Magazine, Mar. 1985, p. 32.

Enticements Limited Catalogue, Holiday 1984 issue, p. 8.

*Primary Examiner*—A. Bartis

*Attorney, Agent, or Firm*—Panitch Schwarze Jacobs & Nadel

[57] ABSTRACT

A combination hair-dryer and garment ironing apparatus includes a housing having an air inlet and a pair of air outlets. A blower and electric heater in the housing create a flow of heated air through the housing. A permanent, non-removable iron assembly is provided on the housing and includes a sole plate disposed in the path of the heated air flow through the housing. The sole plate forms a portion of a wall of the housing and has an exposed generally flat ironing surface. A heated air diverter member within the housing is selectively movable between a first dryer position in which substantially all of the heated air flowing through the housing is diverted from contact with the sole plate and is exhausted through one of the outlets and a second iron position in which a substantial portion of the heated air flow is diverted into contact with at least a portion of the sole plate for impingement heating of the sole plate to an ironing temperature and is exhausted from the other air outlet. The diverter member is retained in either the first or second position. The housing includes a foldable handle having an extended position for use during drying and a folded position for ironing.

10 Claims, 10 Drawing Figures

U.S. PATENT DOCUMENTS

| | | | |
|---|---|---|---|
| 3,289,313 | 12/1966 | Lechner, Jr. et al. | 34/48 |
| 3,518,776 | 7/1970 | Wolff et al. | 34/97 |
| 3,645,007 | 2/1972 | Scott | 34/91 X |
| 3,814,898 | 6/1974 | Levine | 219/362 |
| 3,846,047 | 11/1974 | Wada et al. | 34/97 X |
| 3,947,659 | 3/1976 | Ono | 34/91 X |
| 3,986,272 | 10/1976 | Feierabent | 34/97 |
| 4,078,525 | 3/1978 | Chiba | 38/77.83 |
| 4,114,022 | 9/1978 | Braulke | 34/97 X |
| 4,139,014 | 2/1979 | Rowland | 132/11 A |
| 4,161,955 | 7/1979 | Webb | 34/90 X |
| 4,195,416 | 4/1980 | Hall | 34/90 |
| 4,198,556 | 4/1980 | Crowley et al. | 219/370 |
| 4,198,558 | 4/1980 | Benty | 219/373 X |
| 4,254,324 | 3/1981 | Vrtaric | 219/370 X |
| 4,267,430 | 5/1981 | Downey | 219/222 |
| 4,366,368 | 12/1982 | Stephens | 219/373 X |
| 4,406,071 | 9/1983 | Buchanan | 34/91 |
| 4,524,263 | 6/1985 | Yamac | 219/249 |

COMBINATION DRYER AND IRON

BACKGROUND OF THE INVENTION

The present invention comprises a dryer of the electrical type and, more particularly, a dryer in combination with an iron.

The present invention was developed primarily to meet the needs of the person who travels for business or pleasure. Due to the ease of modern hair styling techniques and the perceived need to always present a neat appearance, many people utilize a dryer, such as a blow dryer, for drying and styling their hair. Thus, when a person is traveling, it becomes desirable and even necessary that such a dryer be taken along for use in a hotel, motel, or other accommodation. Likewise, a traveler concerned with the appearance of his or her clothing often finds it desirable or necessary to bring along an iron for the purpose of smoothing out wrinkles or otherwise touching up the appearance of garments.

In order to assist the traveler, hair dryers, particularly blow dryers, have been made portable and have been miniaturized. Similarly, irons have also been miniaturized and have been made collapsible or foldable for convenient storage and transport. Although such appliances are widely used, there is still a need for an appliance which combines the features of a dual voltage blow dryer and an iron into a single, lightweight package which takes up no more space than a popular travel hair dryer.

SUMMARY OF THE INVENTION

Briefly stated, the present invention provides a combination dryer and iron product comprising a housing having air inlet means and air outlet means. Blower means are provided within the housing for creating an air flow through the housing by drawing air into the housing through the air inlet means and exhausting air from the housing through the air outlet means. Heater means are provided in the housing for heating the air flowing through the housing. A permanenet, nonremovable iron assembly which includes a sole plate forms a portion of a wall of the housing. The sole plate has an exposed generally flat ironing surface. For utilization as an iron, the sole plate is disposed in the path of the heated air exhausted from the housing through the air outlet means. A diverter means within the housing is movable between a first, dryer position in which substantially all of the heated air flowing through the housing and exhausted through the air outlet means is diverted from contact with the sole plate, and a second, iron position in which a substantial portion of the heated air flowing through the housing and exhausted through the air outlet means is diverted into contact with at least a portion of the sole plate for impingement heating of the sole plate. Means are provided for retaining the diverter means in either the first position or the second position. In a preferred embodiment, the air outlet means comprises first and second air outlet openings with the sole plate disposed in the path of heated air exhausted through the second outlet opening, substantially all of the heated air is exhausted through the first outlet opening when the diverter is in the first position and substantially all of the heated air being exhausted through the second air outlet opening when the diverter means is in the second position.

BRIEF DESCRIPTION OF THE DRAWINGS

The foregoing summary, as well as the following detailed description, will be better understood when read in conjunction with the appended drawings. For the purpose of illustrating the invention, there is shown in the drawings an embodiment which is presently preferred, it being understood, however, that the invention is not limited to the precise arrangement and instrumentality shown. In the drawings.

DESCRIPTION OF PREFERRED EMBODIMENT

Figure 1:
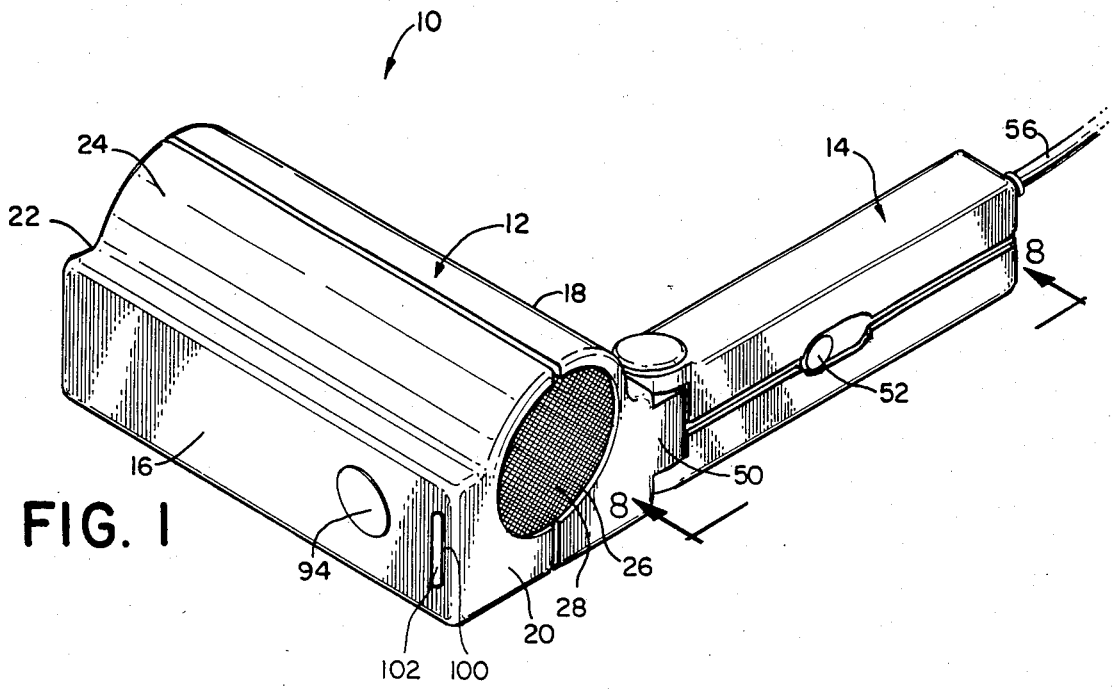
FIG. 1 is a top perspective view taken from the air inlet end of a combination dryer and iron apparatus with the handle in an extended position in accordance with the present invention.
Figure 2:
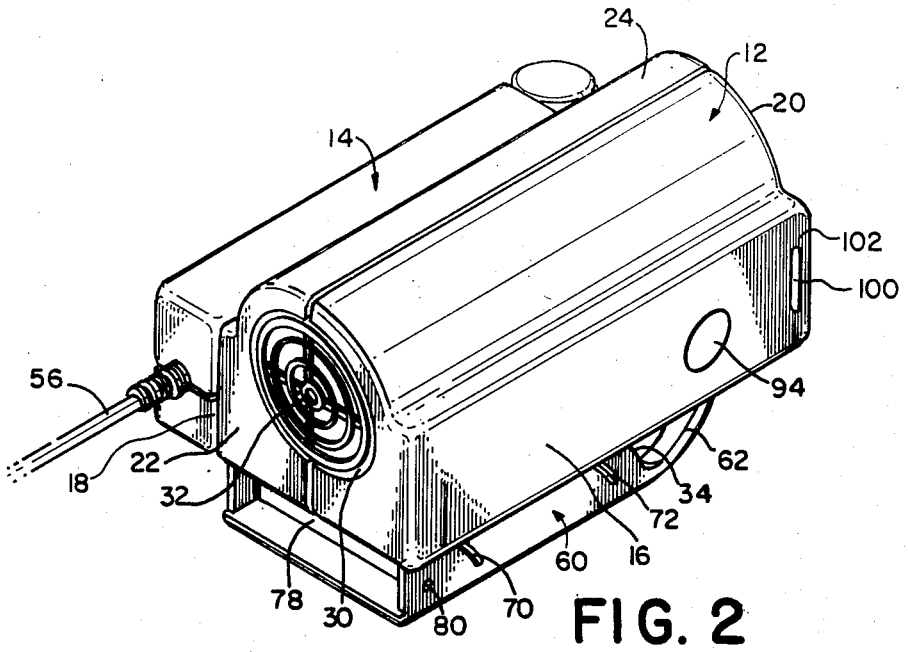
FIG. 2 is a top perspective view of the apparatus of FIG. 1 taken from the first air outlet end with the iron assembly extended and the handle in the retracted position.

Referring to the drawings, wherein the same numerals indicate like elements throughout, there is shown in FIGS. 1 and 2 a combination dryer and iron apparatus generally designated 10. The apparatus 10 is comprised of a generally closed housing 12 and a foldable handle 14 secured to the housing in a manner which will hereinafter be described.

In the present embodiment, the housing 12 is generally in the shape of a parallelepiped, including generally rectangular left and right side surfaces 16 and 18, respectively, and end surfaces 20 and 22. The top surface 24 of the housing 12 is generally flat proximate the right and left sides 16 and 18, but for reasons which will hereinafter become apparent, is generally curved in the area between the two sides 16 and 18. One housing end 20 serves as the inlet end and includes air inlet means, in the present embodiment a generally circular air inlet opening 26 which includes a suitable screen or grate 28 to prevent small objects from being drawn into the housing 12.

Air outlet means are provided for exhausting air from the housing 12. In the present embodiment, the air outlet means comprises a first generally circular air outlet opening 30 extending through the other housing end 22. The first air outlet opening includes a generally circular grate 32 for preventing objects from entering the housing 12. The air outlet means also comprises a second air outlet opening 34 (best seen in FIG. 4) which will hereinafter be described in greater detail.

Figure 6:
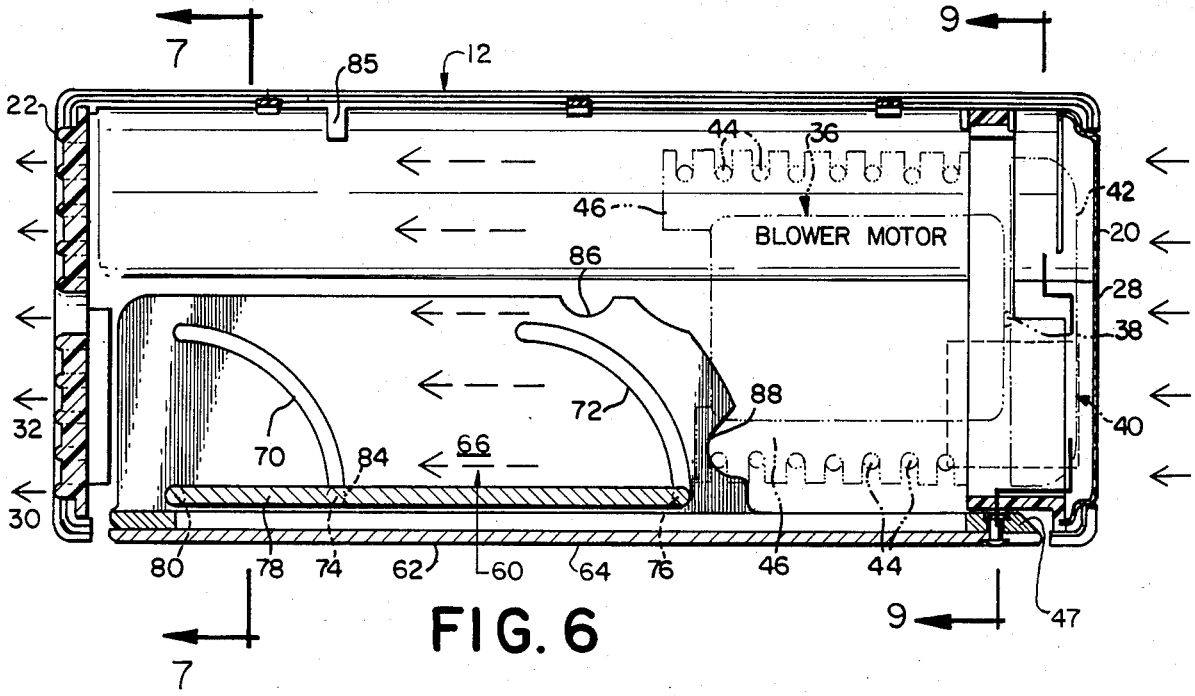
FIG. 6 is an enlarged sectional view of the apparatus taken along line 6—6 of FIG. 7.
Figure 9:
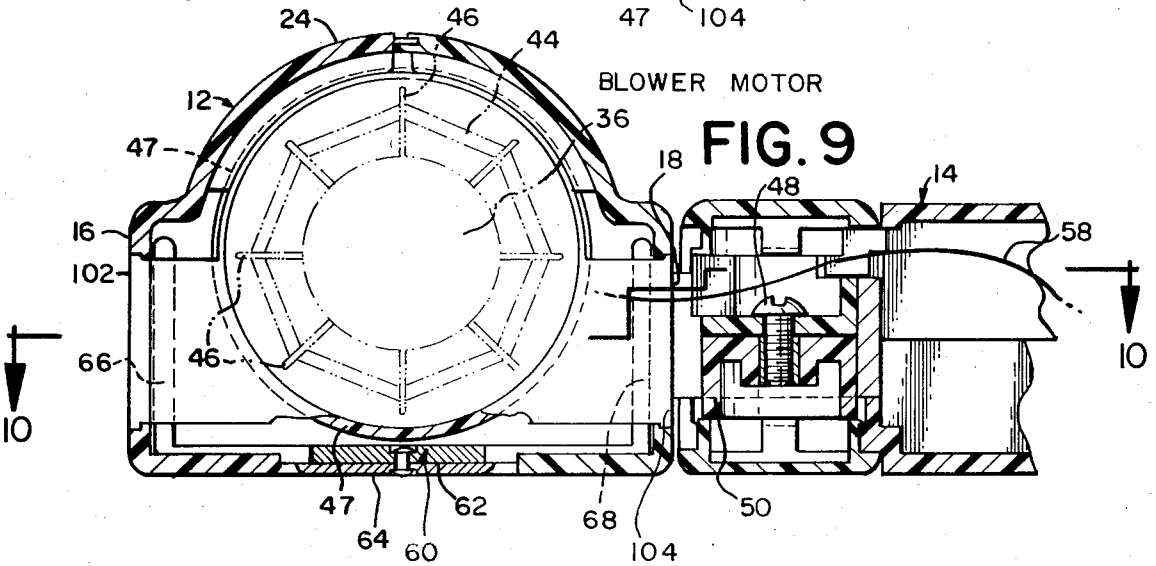
FIG. 9 is an enlarged sectional view of the apparatus taken along line 9—9 of FIG. 6.

Referring now to FIGS. 6 and 9, the apparatus 10 further includes blower means for creating an air flow through the housing 12 by drawing air into the housing through the air inlet opening 26 and for exhausting air from the housing through the air outlet means, in the present embodiment air outlet openings 30 or 34. In the present embodiment, the blower means comprises a small generally cylindrically shaped electrically powered motor shown in phantom as 36. The motor 36 is a sub-horsepower motor capable of operating at different rotational speeds and is typical of the type of motor commonly employed in prior art blow dryers. Motors of this type are commercially available from a variety of motor manufacturers. Complete details of the structure and operation of the motor 36 may be obtained from the motor manufacturers and are not believed to be necessary for a complete understanding of the present invention. Suffice it to say that the application of electrical power to the motor 36 results in the rotation of the motor output shaft 38 at a predetermined rotational speed which may be controlled and varied in a manner well known in the art.

The motor output shaft 38 is drivingly connected to a rotatable impeller means 40 located proximate the air inlet opening 26. The impeller means includes a plurality of circumferentially spaced radially extending impeller or fan blades 42. The fan blades 42 are oriented so that the rotation of the impeller 40 causes air to be drawn into the housing 12 through the air inlet opening 26. Of course, as air is drawn into the housing 12 through the air inlet opening 26 a similar flow of air is forced out of the housing 12 or exhausted from the first and second air outlet openings 30 and 34 as described in greater detail below. The rotational speed of the impeller 40 as determined by the rotational speed of the motor output shaft 38 determines the flow rate of the air flowing through the housing 12.

Heater means within the housing 12 are employed for heating the air flowing through the housing. In the present embodiment, the heater means comprises an electrical resistance heating device formed of a generally continuous wire which is wound around the exterior of the motor 36 to form a heating coil 44. The heating coil 44 may be comprised of Nichrome wire or any other suitable electrical resistance substance which operates to convert electrical energy into heat energy. In the present embodiment, the heating coil 44 is maintained at a predetermined distance from the motor 36 by a plurality of insulator members 46 which extend radially outwardly at circumferentially spaced intervals around the motor 36. The insulator members 46 are formed of mica or any other suitable heat insulation material having sufficient strength to support and maintain the heating coil 44 at a predetermined distance from the motor 36. The circumferential spacing of the insulator members 46 (see FIG. 9) is sufficient to permit the air flowing through the housing 12 to be heated as it flows by and around the heating coil 44. The temperature of the heating coil 44 and thus the temperature of the air flowing through the housing may be controlled and varied in a manner well known in the art. Additional insulation (not shown) may be provided between the heating coil 44 and the housing 12 to protect the portion of the housing proximate the heating coil from overheating.

The motor 36, impeller 40 and heating coil 44 are surrounded by a generally cylindrical member 47 supported by a plate 100 projecting into the housing sides 16 and 18 through apertures 102 and 104 respectfully As shown in FIGS. 1 and 2, the handle 14 is rotatably secured to the right side 18 of the housing proximate the air inlet end 20. FIG. 1 shows the handle 14 in the unfolded or extended position whereby a person wishing to use the apparatus 10 as a dryer can conveniently grasp the handle 14 to direct the heated air flow exhausted through the first air outlet opening 30 toward the person's hair, or an article being dried. Similarly, FIG. 2 shows the handle 14 in the folded or unextended position in which the overall space taken up by the apparatus 10 is minimized for convenient storare and transport.

Figure 10:
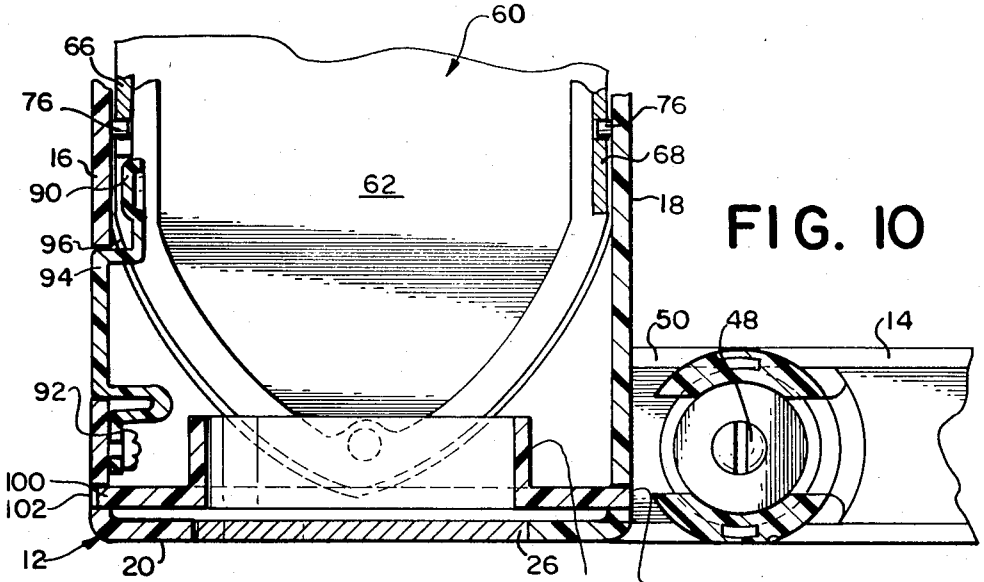
FIG. 10 is a partial sectional view of the apparatus taken along line 10—10 of FIG. 9.

As best seen in FIGS. 9 and 10, in the present embodiment, the handle 14 is secured to the housing 12 by a screw member 48 which interconnects one end of the handle 14 to an outwardly extending hinge portion 50 of the housing 12. Connecting the handle 14 to the housing 12 in this manner permits the handle 14 to be folded closely against the housing right side surface 18 to provide a compact configuration for storage and travel.

The handle 14 includes control means for controlling the speed of the blower means or motor 36 and for controlling the temperature of the heater means or heating coil 44. In the present embodiment, the control means comprises a single, multiple position slide-type switch 52 and associated electrical circuitry shown generally in phantom as 54. The electrical circuitry 54 also operates to permit the apparatus 10 to selectively operate with different types of power, for example, 110 V, 220 V, etc. An electrical power cord 56 extending from the other end of the handle 14 conducts electricity to the switch 52 and the electrical circuitry 54. Suitable cable or wire means 58 (FIG. 9) are provided for conducting electrical current from the circuitry 54 to the motor 36 and to the heating coil 44.

In the present embodiment, the switch 52 and the electrical circuitry 54 are typical fo those which are employed in prior art dryers. A detailed description of the structure and operation of the electrical circuitry 54 and of the multiple position slide switch 52 is not believed to be necessary for a complete understanding of the present invention. Suffice it to say that by moving the switch 52 to differing positions, the circuitry 54 operates to vary the current flow through the heating coil 44 to operate the heating coil at varying temperatures.

Likewise, movement of the switch 52 causes the electrical circuitry 54 to operate the motor 36 at varying speeds to vary the flow of the air passing through the housing 12. The switch 52 may comprise a pair of individual switches (not shown), one such switch for controlling the temperature of the heating coil to control the temperature of the heated air, and the other switch controlling the speed of rotation of the motor output shaft 38 to control the flow rate of the air passing through the housing 12. For example, each such switch (not shown) may operate in either a "high", "medium" and "low" position, as well as an "off" position for maximum operational flexibility. The "high" position may result in 1200 watts of drying power, while the other settings may result in less drying power, such as 1,000 watts, 800 watts, etc. Likewise, the motor rotation speed may be varied in accordance with the desired function, for example, a relatively high speed for rapid drying of wet hair or other articles and a relatively low speed for drying delicate articles or for styling hair.

Figure 3:
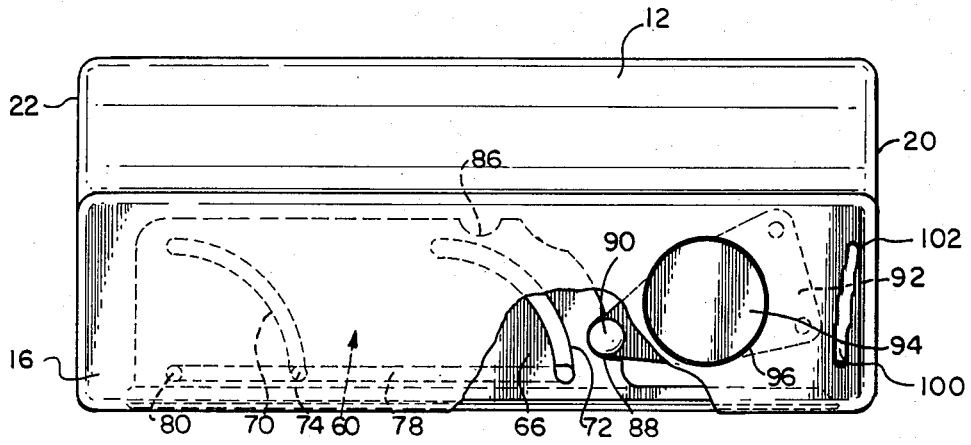
FIG. 3 is an enlarged left side elevation view, partially broken away, of the apparatus of FIG. 1.
Figure 4:
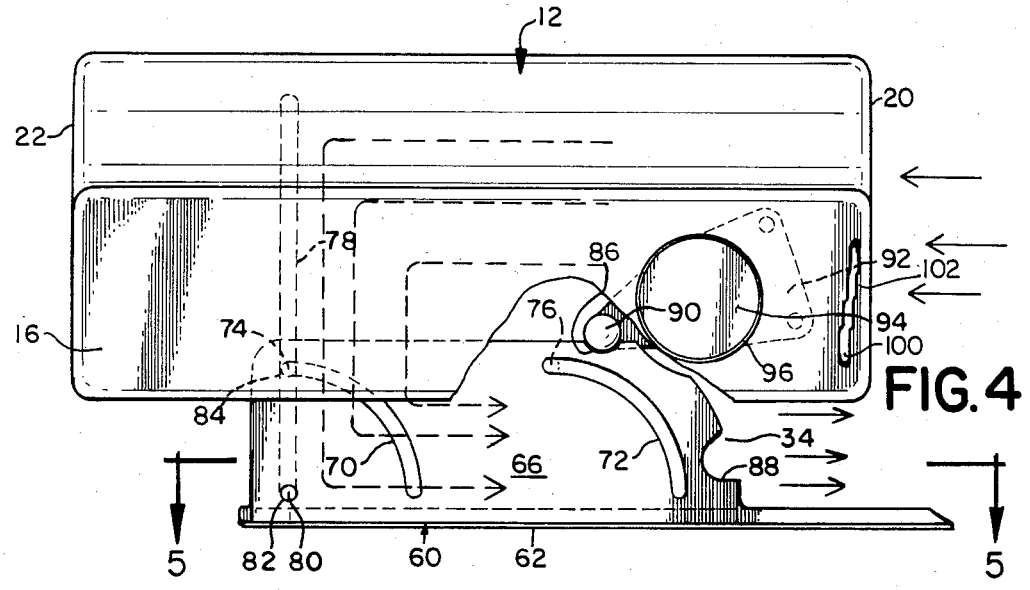
FIG. 4 is a view similar to that of FIG. 3, but with the iron assembly in the extended position.
Figure 5:
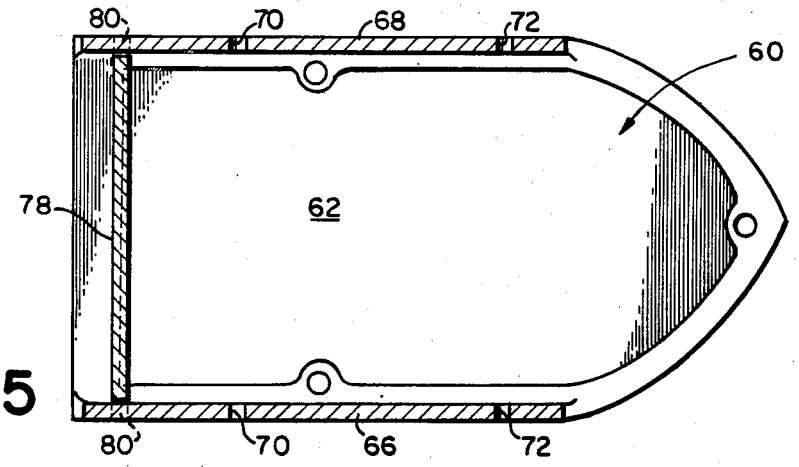
FIG. 5 is a sectional view of a portion of the apparatus taken along line 5—5 of FIG. 4.

For the most part, the structure which has thus far been described is substantially the same as that of a typical portable, hand-held blower-type hair dryer which is commercially available in a variety of styles and sizes from numerous manufacturers. What makes the present apparatus different is that in addition to having the ability to operate as a standard blow dryer as described above, the apparatus 10 may also operate as an iron. To accomplish the latter result, the apparatus 10 further includes an iron assembly 60 located at least partially within the housing 12. The iron assembly 60 includes a sole plate 62 forming a portion of the lower wall of the housing 12 and having an exposed generally flat ironing surface 64. The iron assembly 60 further includes mounting members, in the present embodiment generally flat side panels 66 and 68. One lateral end of each of the mounting members or side panels 66 and 68 is secured to the sole plate 62. the mounting members or side panels 66 and 68 are movably secured to the housing 12 to permit the iron assembly 60 to move between a first or storage position as shown in FIGS. 1, 3 and 6 in which the iron assembly 60 is contained within the housing 12 and a second or operating position as shown in FIGS. 2 and 4 in which at least the sole plate 62 and portions of the side panels 66 and 68 extend outside of the housing 12.

In the present embodiment, the side panels 66 and 68 each include two generally arcuate slots 70 and 72 extending therethrough. The iron assembly 60 is movably secured to housing 12 by two pairs of pin members 74 and 76 which extend through the arcuate slots 70 and 72. In the present embodiment, each of the pin members 74 and 76 is generally cylindrical and extends inwardly from the housing sidewalls 16 and 18 and through slots 70 and 72 of the side panels 66 and 68. The iron assembly 60 can be moved to the operating position as shown in FIGS. 2 and 4 by pulling the iron assembly 60 outwardly (downwardly when viewing FIGS. 3 and 4) to slide the arcuate slots 70 and 72 with respect to the pin members 74 and 76. As the iron assembly 60 moves out of the housing 12 the curvature of the slots 70 and 72 causes the iron assembly to also move toward the air inlet end 20 (toward the right when viewing FIGS. 3 and 4) to the position shown in FIG. 4. Similarly, the iron assembly 60 can be moved to the storage position as shown in FIGS. 1, 3 and 6 by pushing the iron assembly inwardly (upwardly when viewing FIGS. 3 and 4) to slide the arcuate slots 70 and 72 with respect to the pin members 74 and 76. Of course, as the iron assembly 60 moves into the housing 12, it also moved toward the first air outlet end 22 (toward the left when viewing FIGS. 3 and 4) to the position shown in FIG. 3.

Figure 7:
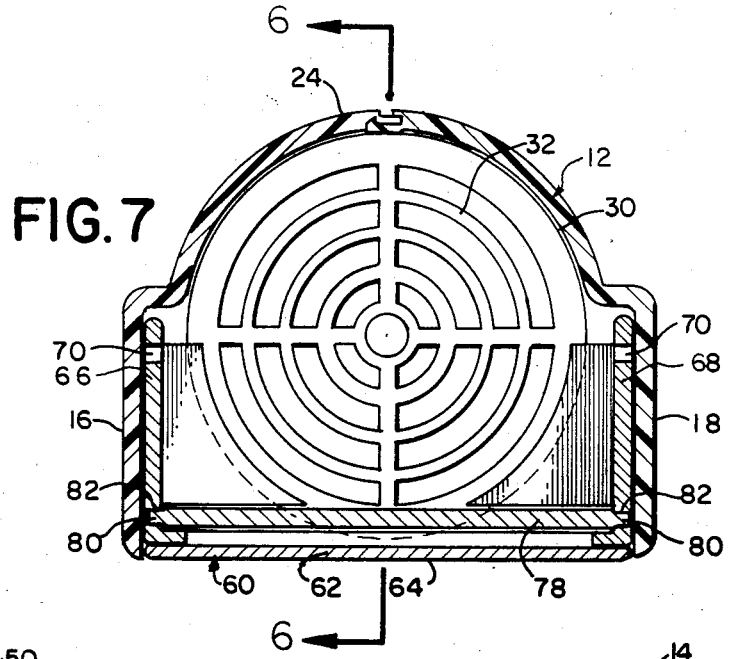
FIG. 7 is an enlarged sectional view of the apparatus taken along line 7—7 of FIG. 6.
Figure 8:
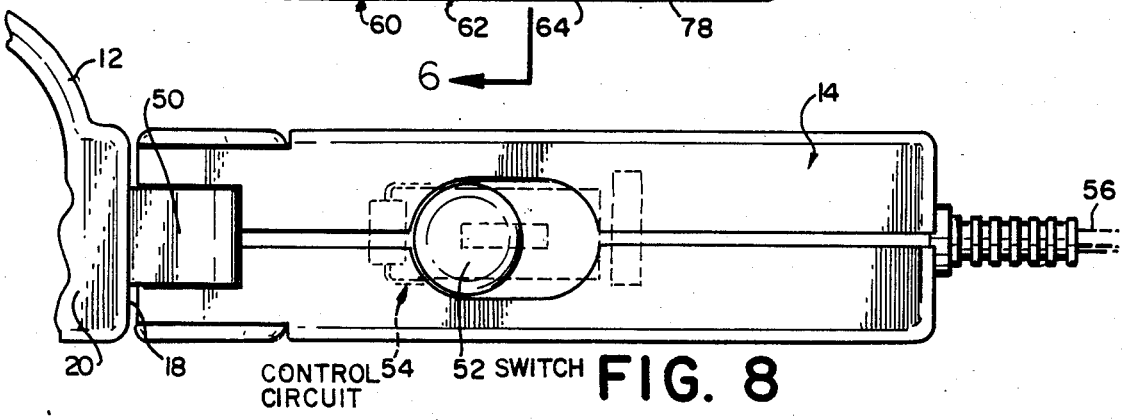
FIG. 8 is an enlarged partial end elevation view of the apparatus taken along line 8—8 of FIG. 1.

A diverter means, in the present embodiment a generally flat diverter member 78 is employed for controlling the direction of the air flow through the housing 12. As best seen in FIGS. 4 and 7, one end (left end when viewing FIG. 4) of the diverter member 78 is pivotally secured to each of the iron assembly side panels 66 and 68. In the present embodiment, the diverter member 78 is pivotally secured to the side panels 66 and 68 by a pair of pin members 80 which extend outwardly from the diverter plate 78 and into suitably sized openings 82 extending through the side panels 66 and 68.

Pin members 74, after extending through arcuate slots 70 extend into suitably sized openings 84 in the diverter member 78. By pivotally securing the diverter member 78 in this manner, the diverter member 78 moves with the iron assembly 60. When the iron assembly moves to the storage position, as shown in FIG. 3, the diverter member 78 pivots downwardly, to a position generally parallel with the sole plate 62. When the iron assembly 60 moves to the operating position as shown in FIG. 4, the diverter member 78 pivots upwardly to a position generally perpendicular to the sole plate 62. As will hereinafter become apparent, the position of the diverter member 78 determines whether the apparatus operates as a dryer or an iron to permit safe operation when either function is being performed.

The housing 12 further includes stop means for engaging the diverter member 78 when the diverter member is in the second or operating position as shown in FIG. 4. In the present embodiment, the stop means comprises a shoulder member 85 (see FIG. 6) extending generally inwardly from at least the curved portion of the housing top 24. The diverter member 78 abuts against the shoulder member 85 when the diverter member is moved into the operating position. Of course, the distal end of the diverter member 78 is suitabley formed to complement and correspond to the curvature of the housing top 24.

Means are also provided for securing or locking the iron assembly 60 into either the first or second positions. In the present emobdiment, the locking means comprises a pair of generally arcuate grooves 86 or 88 extending through one of the iron assembly side panels 66. A pin member 90 is movably secured to the housing 12 and is adapted for engaging one of the arcuate grooves 86 or 88, depending upon the position of the iron assembly 60 with respect to the housing 12. Biasing means are provided for movably biasing the pin member 90 into engagement with one of the arcuate grooves 86 and 88. In the present embodiment, the biasing means comprises an irregularly shaped member 92 having the pin member 90 secured at one end and being secured to the housing 12 at the other end. Actuator means, in the present embodiment a generally cylindrical button portion 94 of the biasing member 92, extends through a suitably sized opening 96 in the housing 12.

As can be seen from FIG. 3, the iron assembly 60 can be secured in the first or storage position with the pin member 90 engaging groove 88. To move the iron assembly 60 to the second or operating position as shown in FIG. 4, the button portion 94 is momentarily depressed relative to the housing 12, thereby moving the pin member 90 out of engagement with groove 88 to release the side panel 66. The iron assembly 60 may then be pulled out of the housing 12 by moving the side panel arcuate slots 70 and 72 with respect to the pin member 74 and 76. Movement of the iron assembly 60 outwardly results in a corresponding inward or upward pivotal movement of the diverter member 78 as previously described. When the iron assembly 60 and the diverter member 78 reach the second or operating position as shown in FIG. 4, the pin member 90 is biased into engagement with groove 86 to lock the iron assembly 60 in the operating position. Movement of the iron assembly 60 back into the storage position within the housing 12 is accomplished in a similar manner by momentarily depressing the button portion 94 to release the pin member from groove 86 and pushing the iron assembly 60 upwardly until the pin member 90 again engages groove 88.

When the iron assembly 60 is in the operating position, as shown in FIG. 4, the diverter member 78 blocks or diverts substantially all of the heated air from passing out of the housing 12 through the first air outlet opening 30. Instead, the heated air is diverted out of the second air outlet opening 34 which if formed by the sole plate 62 and the iron assembly side panels 66 and 68. As the heated air passes out of the second air outlet opening 34, it impinges upon the diverter member 78, the iron assembly side panels 66 and 68 and the sole plate 62 for impingement heating thereof. Although the diverter member 78 of the present embodiment is generally flat, it could be curved to enhance air flow efficiency and to improve heat transfer.

In the present embodiment, the diverter member 78, the iron assembly side panels 66 and 68 and the sole plate 62 are fabricated of a lightweight material which provides maximum heat absorption. An example of such a material is an aluminum or zinc alloy. In addition, the interior surfaces of each of these components may be painted black to further promote the absorption of heat from the heated air flow passing through the housing and out of the second air outlet opening 34. Since the sole plate 62 extends beyond the housing, the heat absorbed by the diverter member 78 and the side panels 66 and 68 tends to move towards the sole plate 62.

The apparatus 10 can be conveniently utilized for the ironing of fabrics and other materials just like any other iron. The temperature of the sole plate 62 can be controlled by controlling the speed of the motor 36 to control the air flow rate through the housing 12. Further control of the temperature of the sole plate 62 can be obtained by controlling the temperature of the heating coil 44 in conjunction with the air flow rate. In this manner, the sole plate temperature may be adjusted for the particular fabric being ironed. For example, a higher sole plate temperature could be utilized when ironing an all cotton fabric, whereas a lower sole plate temperature could be utilized when ironing a more delicate fabric such as rayon or some other synthetic fabric.

As previously indicated, the handle 14 is foldable between an extended position as shown in FIG. 1 and a folded or unextended position as shown in FIG. 2. It should be appreciated that the handle 14 may be placed in either of the two positions, or in any position therebetween when the apparatus 10 is operated either as a dryer or an iron. For example, when the apparatus 10 is being operated as an iron, it may be convenient for people with larger-sized hands to have the handle 14 in the folded position, as shown in FIG. 2, to provide a wider gripping area. Conversely, people with smaller-sized hands may wish to iron with the handle 14 in the extended position, as shown in FIG. 1, to provide a smaller gripping area comprising only the housing 12.

From the foregoing description, it can be seen that the present invention comprises a combination dryer and iron apparatus which is portable, compact, and easily transportable. It will be recognized by those skilled in the art that changes may be made to the above-described embodiment of the invention without departing from the broad inventive concepts thereof. For example, the iron assembly 60 could be permanently secured in an extended or partially extended position (not shown). It is understood, therefore, that this invention is not limited to the particular embodiment disclosed, but it is intended to cover any modifications which are within the scope and spirit of the invention as defined by the appended claims.

We claim:

1. A combination dryer and iron comprising:

a housing having air inlet means and air outlet means;

blower means within the housing for creating an air flow through the housing by drawing air into the housing through the air inlet means and exhausting air from the housing through the air outlet means;

heater means within the housing for heating the air flowing through the housing;

a permanent, non-removable iron assembly including a sole plate forming a portion of a wall of the housing and having an exposed generally flat ironing surface for utilization as an iron, the sole plate being disposed in the path of the heated air exhausted from the housing through the air outlet means; and diverter means within the housing and selectively movable between a first, dryer position in which substantially all of the heated air flowing through the housing and exhausted through the air outlet means is diverted from contact with the sole plate and a second, iron position in which a substantial portion of the heated air flowing through the housing and exhausted through the air outlet means is diverted into contact with at least a portion of the sole plate for impingement heating of the sole plate and means for retaining said diverted means in either said first position or said second position.

2. The apparatus as recited in claim 1 wherein the air outlet means comprises first and second air outlet openings, said sole plate being disposed in the path of heated air exhausted through the second outlet opening, substantially all of the heated air being exhausted through the first air outlet opening when the diverter means is in the first position, and substantially all of the heated air being exhausted through the second air outlet opening when the diverter means is in the second position.

3. The apparatus as recited in claim 2 wherein the iron assembly further includes a pair of mounting members for supporting the sole plate, the mounting members being secured to opposite sides of the sole plate.

4. The apparatus as recited in claim 3 wherein the mounting memebers are movably secured to the housing to permit the iron assembly to move to a first position within the housing and to a second position where at least the sole plate extends partially outside of the housing.

5. The apparatus as recited in claim 4 wherein the diverter means includes a diverter member disposed between and pivotally secured to the mounting members, the diverter member blocking the heated air from exhausting through the first air outlet opening when the diverter member is in the second position.

6. The apparatus as recited in claim 5 wherein the diverter member is adapted for movement with the movement of the iron assembly, the diverter member moving to the first position in response to the iron assembly being moved to the first position, the diverter member moving to the second position in response to the iron assembly being moved to the second position.

7. The apparatus as recited in claim 6 further including stop means within the housing for engaging the diverter member when the diverter member is in the second position.

8. The apparatus as recited in claim 4 further including means for locking the iron assembly either into the first or the second position.

9. The apparatus as recited in claim 8 wherein the locking means comprises:

a pair of generally arcuate grooves on at least one of the iron assembly mounting members;

a pin member movably secured to the housing and adapted for engaging at least one of the arcuate grooves; and biasing means for biasing the pin member into engagement with one of the grooves.

10. The apparatus as recited in claim 4 wherein the mounting members include arcuate slots extending therethrough, the housing further including pin members for engaging the arcuate slots to movably secure the iron assembly to the housing.

* * * * *